US007032761B2

(12) United States Patent
Nagel

(10) Patent No.: US 7,032,761 B2
(45) Date of Patent: Apr. 25, 2006

(54) PRODUCT DISPLAY RACK WITH FRONT BARRIER PANEL

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 271 days.

(21) Appl. No.: 10/700,317

(22) Filed: Oct. 31, 2003

(65) Prior Publication Data

US 2005/0092702 A1 May 5, 2005

(51) Int. Cl.
*A47F 7/00* (2006.01)

(52) U.S. Cl. ..... 211/59.3; 312/71

(58) Field of Classification Search ..... 211/59.3, 211/133.5, 90.03, 74, 85.31, 184, 181.1, 126.9; 312/61, 71

See application file for complete search history.

(56) References Cited

U.S. PATENT DOCUMENTS 3,110,402 A 11/1963 Mogulescu
3,308,961 A * 3/1967 Chesley ..... 211/59.3
4,899,893 A * 2/1990 Robertson ..... 211/59.3
5,645,176 A * 7/1997 Jay ..... 211/59.2
5,855,283 A 1/1999 Johnson
6,299,004 B1 10/2001 Thalenfeld et al.
6,719,152 B1 * 4/2004 Nagel et al. ..... 211/59.3
6,745,906 B1 * 6/2004 Nagel ..... 211/59.3
6,866,155 B1 * 3/2005 Nagel ..... 211/59.3
6,886,700 B1 * 5/2005 Nagel ..... 211/59.3

* cited by examiner

*Primary Examiner*—Jennifer E. Novosad
(74) *Attorney, Agent, or Firm*—Schweitzer Cornman Gross & Bondell LLP

(57) ABSTRACT

A product display device is comprised of a wire base structure with a plurality of spaced-apart, straight parallel wire supports extending in a front-to-back direction, and wire cross bars underlying the wire supports adjacent their front and back ends. Plastic base elements are snap-fitted to the cross bars at the front and back ends of the wire base structure, and a pusher is provided on the base structure for urging displayed product items toward the front. A molded plastic barrier panel is mounted at the front of the front base element by vertical tabs which are received in vertical grooves at the front of the base element. The plastic barrier panel can be made of clear, transparent material for optimum viewing of the product being displayed. The panels can accommodate the presence of product identifying logos, graphics or other special information associated with a particular product.

11 Claims, 4 Drawing Sheets

PRODUCT DISPLAY RACK WITH FRONT BARRIER PANEL

RELATED APPLICATIONS

This application is related to the Thomas O. Nagel, et al. U.S. applications Ser. No. 10/024,153, filed Dec. 17, 2001, now U.S. Pat. No. 6,719,152, granted Apr. 13, 2004, and Ser. No. 10/406,984, filed Apr. 4, 2003, now U.S. Pat. No. 6,866,156, granted Mar. 15, 2005, as well as to the Thomas O. Nagel U.S. applications Ser. No. 10/219,800, filed Aug. 16, 2002, now U.S. Pat. No. 6,745,906, granted Jun. 8, 2004, and Ser. No. 10/323,461, filed Dec. 18, 2002, now U.S. Pat. No. 6,866,155, granted Mar. 15, 2005. All of the foregoing are assigned to the assignee of this application, Trion Industries, Inc., Wilkes-Barre, Pa.

BACKGROUND OF THE INVENTION

The invention relates to product display systems, particularly but not exclusively to wire-based product display devices provided with width-adjustable side guides and spring-actuated pusher mechanisms for maintaining displayed product items at the front of the display device. The Nagel and Nagel et al. applications referred to above disclose preferred forms of such devices, in which a wire product support is mounted at front and back ends by plastic base elements. The plastic base elements have parallel transverse recesses therein for the adjustable reception of transverse mounting portions of product side guides. A pusher sled is mounted on the wire product support and is urged in a forward direction by means of a coiled spring, such that the pusher constantly urges the product items to the front of the display.

A barrier element is needed at the front of the display, in order to establish a forwardmost position for the displayed product. In the devices disclosed in the before mentioned applications, the forward limit stop typically is formed by extending a portion of the wire product support in an arc, from one side of the support to the other, to form an integral vertical barrier at the front of the display. Although the need for a front barrier in displays of the described type is evident, the provision of a wire element extending over the front of the display is objected to by some merchandisers, particularly where the presence of the wire barrier element interferes with the visual impression sought by the merchandiser with respect to graphics printed on the exposed face of the displayed product. In some cases, merchandisers have mounted a transparent barrier panel extending along the width of the shelf and serving as a front limit for pusher-actuated displays mounted on the shelf. Such an arrangement has certain disadvantages, however, making them less than optimum for the purpose. Typically, such full-width barrier panels are, of necessity or practicality, formed by extrusion, and the long-term clarity of the extruded product is less than optimum. In other cases, for example where the display racks are mounted individually on a perforated panel board display, the use of such extended barrier panels is not possible.

The present invention provides an improved product display device that obviates the disadvantages discussed above.

SUMMARY OF THE INVENTION

The present invention provides a product display device of the general type described above, comprising a wire product support structure mounted at its opposite ends by plastic base elements and provided with a pusher sled for urging displayed product items to the front of the display. At the front of the display device, a barrier panel is provided to limit forward movement of the displayed product items. The barrier panel preferably is formed of a clear, transparent, strong plastic material, such as polycarbonate, and is formed by injection molding, rather than by extrusion, for example, in order to achieve a high level of clarity and transparency.

As a feature of the invention, the barrier panel has a snap-fit, rigid attachment to the front plastic base element on which the wire product support is mounted. The barrier panel can be molded in several heights, to suit the particular type of merchandise being displayed. In any case, however, the barrier panel, if formed of clear, transparent plastic material, provides direct visual access to the front of the display product, without interrupting the customer's view.

A merchandiser's or product logo may be provided in an appropriate area of the barrier panel, where such is desired. Further, inasmuch as the barrier panels are of injection molded construction, a product logo may be permanently molded into the barrier panel where desired.

In product displays of the type above referred to, it is usually desired to provide the product supports in one or two "standard" sizes, each designed for products of a predetermined minimum width. Products of greater width are accommodated by way of laterally adjustable side guides. To this end, it is contemplated that the barrier panels will likewise typically be provided in one or two "standard" widths, consistent with the width of the "standard" product supports. Conceptually, of course, the barrier panels could be provided in a variety of widths as well as various heights, subject of course to somewhat higher molding costs as a function of the greater number of molds required to achieve various barrier panel sizes.

For a more complete understanding of the above and other features and advantages of the invention, reference should be made to the following detailed description of a preferred embodiment thereof, and to the accompanying drawings.

DESCRIPTION OF PREFERRED EMBODIMENTS

Figure 1:
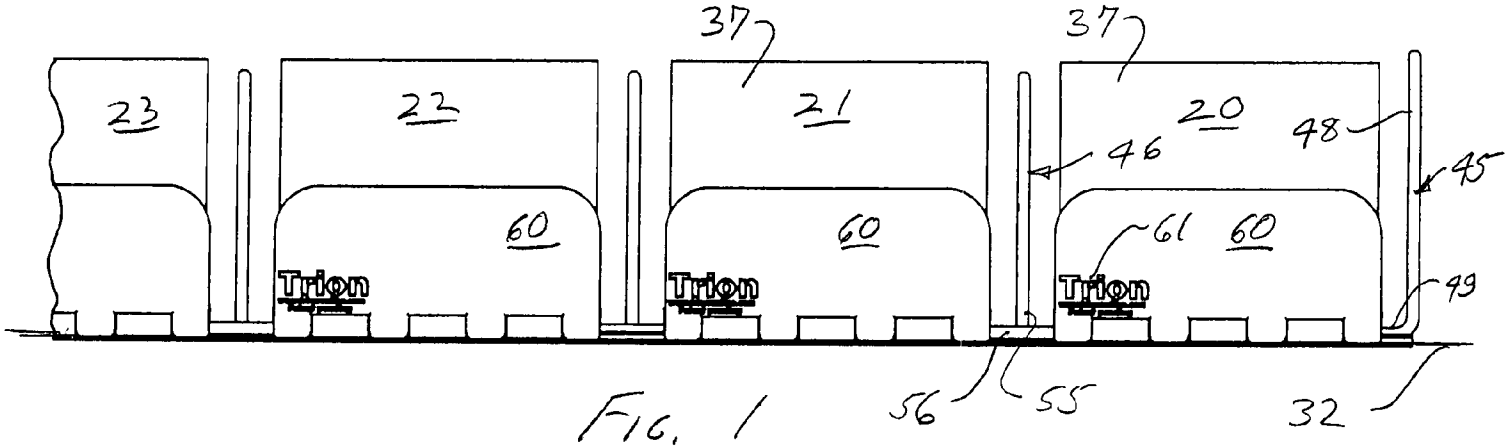
FIGS. 1 and 2 are elevation and perspective views respectively of a shelf-mounted display incorporating a plurality of product display devices according to the invention.
Figure 2:
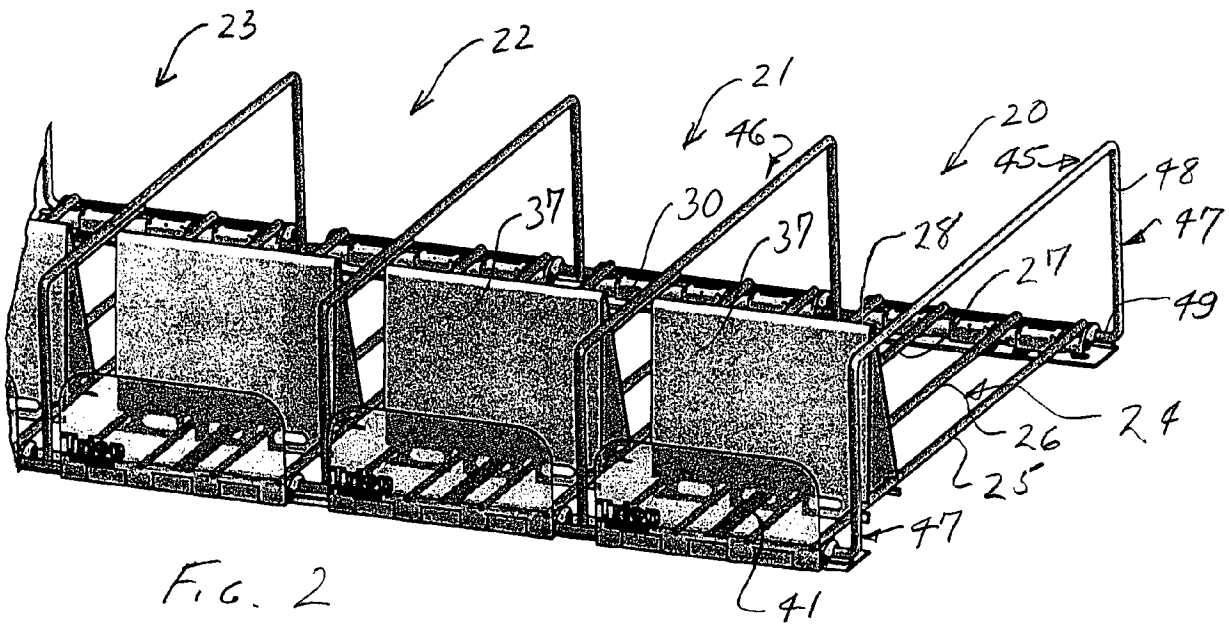
Figure 13:
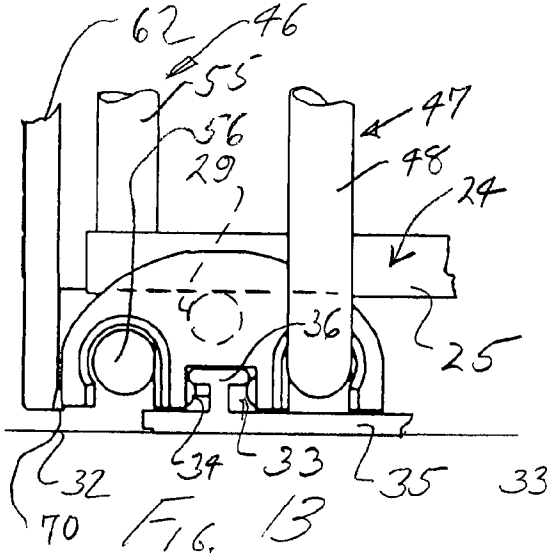
FIG. 13 is an enlarged, fragmentary end elevational view showing the front portion of a display device according to the invention, illustrating features of the plastic base element and front barrier panel.

Referring now to the drawings and initially to FIGS. 1–2 thereof, there is shown a multi-unit product display incorporating a plurality of display devices according to the invention. In FIGS. 1 and 2, three complete units are shown and a portion of a fourth unit. Each of the units, designated generally by the reference numerals 20–23. Each display unit comprises a product support designated generally by the numeral 24 and comprising four longitudinally extending, straight wire support elements 25–28, extending from front to back in spaced-apart, parallel relation and defining a support plane for products to be displayed (not shown). Adjacent their front and back end extremities, the wire support elements are joined underneath by cross bar wires 29 (FIG. 13), typically welded thereto, to form a structurally rigid platform.

At each end, the wire product supports 24 are mounted on front and back plastic base elements 30, shown in detail in FIGS. 7–10 and 13, and to be described more completely hereinafter. The front and back cross bars 29 of the product supports are snap-fitted into upwardly opening recesses 31 in the base elements 30, such that the wire product supports 24 and the plastic base elements 30 form a tightly assembled unit. Preferably, the upwardly opening recesses 31 are formed with overhanging flanges 31*a*, arranged in opposed pairs along the top of the recess. The cross bars 29 are snap-fit through the somewhat narrowed opening between opposed flanges 31*a*, such that the cross bars are tightly retained in the recesses 31, in assembled relation with the support elements 30.

In the form of the invention illustrated in FIGS. 1 and 2, the base elements 30 serve to support the product display on the surface of a display shelf 32. For this purpose, the plastic base elements 30 advantageously are provided with downwardly opening recesses 33, preferably with opposed ridges 34 molded therein. This enables the releasable attachment of the base members 30 to mounting strips 35, formed with a continuously extending T-shaped "rail" 36, which serves to locate the display units in a desired position and alignment on the display shelf.

To advantage, the support elements 30 are notched at 38 to receive lower portions of the longitudinally extending support wires 25–28, and flat support surfaces 39 may be provided on upper surface portions of the base elements on opposite sides of the recess 31, in order to provide a seat for bottom surface portions of the support wires 25–28. This assures that a desired, fixed angular orientation will be maintained between the base elements 30 and the product supports 24, with substantially no rotational motion between the base elements 30 and the product supports 24 being permitted.

Figure 4:
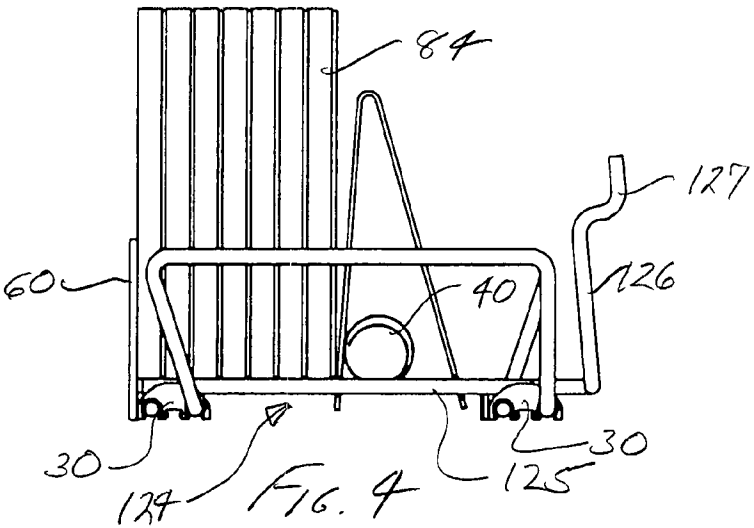
FIGS. 3 and 4 are front and side elevations respectively of a second embodiment of the product display device of the invention, designed for use in a perforated panel display arrangement.
Figure 10:
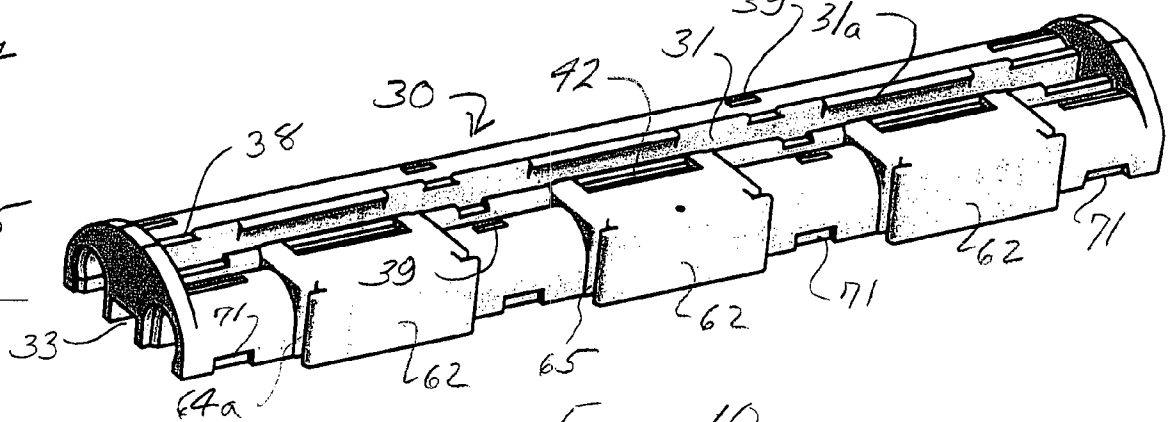
FIG. 10 is a perspective view of the plastic base element of FIGS. 7–9.

Pursuant to prior inventions heretofore referred to and described in certain of the before mentioned Nagel U.S. applications, pusher sleds 37 are mounted on the four wire support elements 25–28 of each product support, for easy sliding movement in forward and rearward directions. A coiled spring 40 (not shown in FIGS. 1 and 2, but evident in the embodiment of FIG. 4) has a forward section 41 extending through a front opening in the pusher sled and attached to the front base element 30 by insertion through a narrow slot 42 therein (FIG. 10). As is well understood, the spring constantly urges the sled 37 in a forward direction, pushing any display product resting on the product support 24 toward the front of the display.

The product items displayed on the supports 24 are confined and guided by wire side guides 45, 46. At the ends of an assembled group of display devices, the side guides 45 are mounted by means of L-shaped supports 47 at each end. These include vertical elements 48 and transverse elements 49. The transverse elements 49 are arranged to be received in one of two downwardly opening recesses 50, extending throughout the entire length of the base members 30. Desirably, the recess 50 is provided with a plurality of vertical friction ribs 51, adapted to engage surface portions of the transverse wire supports 49, to snugly frictionally retain the supports 49 in any adjusted position.

For stand-alone single unit display devices, the side supports may be the same at both sides, although, as set forth in the before mentioned Nagel et al. U.S. application Ser. No. 10/024,153 the second side support (e.g. 46) has its transverse element received in a separate, downwardly opening recess 52, also provided with friction ribs 53 for securely frictionally retaining the side guide in any adjusted position.

In the form of the invention shown in FIGS. 1 and 2, where a plurality of display units are "ganged" in side-by-side relation, intermediate side guide elements 46 are formed with an inverted T-shaped support 55, having a transverse element 56 extending In opposite directions, engaged with base elements 30 of adjacent units. In this manner, all of a series of side-by-side units are joined together, yet each has provision for independent side guide adjustment.

In accordance with the present invention, and as distinguished from disclosures of the before mentioned Nagel and Nagel et al. applications, a barrier to limit forward movement of displayed product on the display units of FIGS. 1 and 2 is provided by means of a barrier panel 60, which is an injection molded item, preferably of a rigid, hard material such as polycarbonate. Typically and advantageously, the barrier panel 60 is formed of a clear, transparent material, allowing optimum visual access to the product item displayed directly behind the panel. However, in appropriate instances, the barrier panels 60 could be formed of opaque material and/or provided with surface graphics or logos consistent with the character of the product being displayed. The barrier panels are mounted vertically, at the front of the forward base element 30, advantageously flush with front surface portions of the support element. As will be described, the barrier panel 60 is adapted for snap-in assembly with the support element 30. Upon being assembled to the base element 30, the panel 60 is rigidly held in a vertical orientation, serving as a front limit stop for merchandise being urged to the front by the sled 37.

Figure 7:
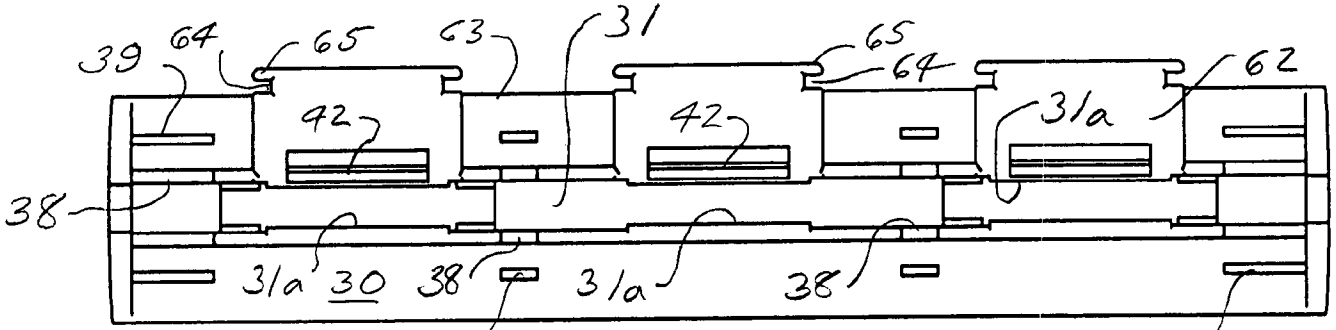
FIGS. 7, 8 and 9 are top plan, front elevation and bottom plan views respectively of a plastic base element incorporated in the product display devices of FIGS. 1–6 and providing means for mounting a front barrier panel.
Figure 8:
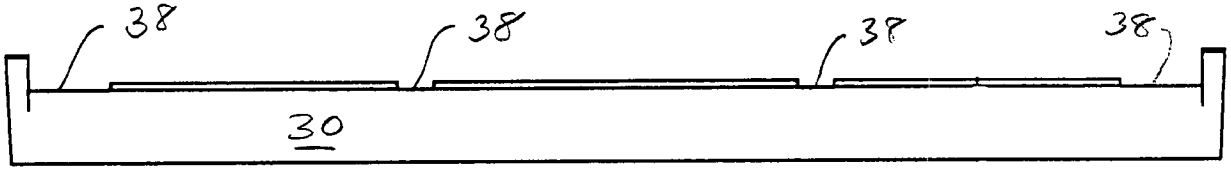
Figure 9:
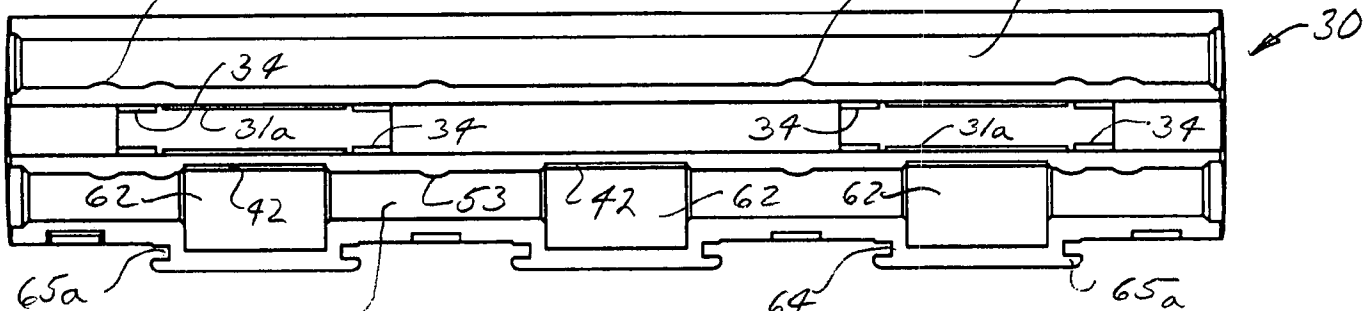

As shown in FIGS. 7–9, the base element 30 is formed with laterally spaced front housings 62 associated with spring-receiving slots 42. Each of the housings 62 is arranged to receive the front end portion of a pusher spring 40, such that, depending upon the character of the merchandise being displayed, the pusher sled may be actuated by a single spring in the center, a pair of springs at opposite sides, or three springs, for particularly heavy objects. Pursuant to the invention, the housings 62 are extended forwardly a short distance beyond the front extremity 63 of the base element 30 and defines a pair of vertical slots 64 and outer flange portions 65.

Preferentially, the base elements 30 are injection molded of an engineering plastic material, such as "Celcon", an acetal copolymer, made available by Ticona, of Summit, N.J., USA.

Figure 11:
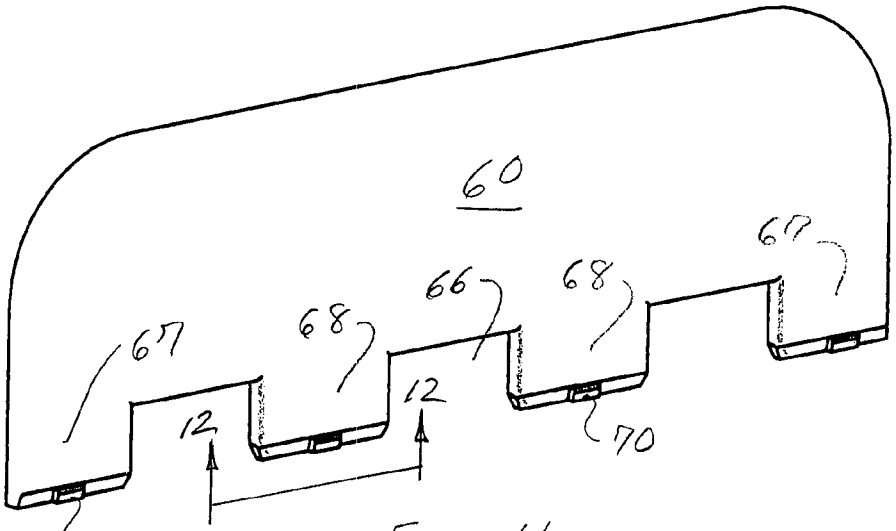
FIG. 11 is a perspective view of a clear, transparent plastic barrier panel incorporated in the display devices of FIGS. 1–6.

As shown in FIG. 11, the barrier panel 60, which may have a typical thickness of around 0.10 inch, is formed with three downwardly opening notches 66, corresponding in location to the position of the front housings 62. On opposite sides of the notches are outer, downwardly projecting outer mounting tabs 67 and inner mounting tabs 68. The inner tabs 68 are designed to fit snugly into the vertical slots 64 between the three housings 62, and the outer tabs 67 are positioned to be received in slots 64*a* along the outer sides of the outer housings 62.

To advantage, each of the mounting tabs 67, 68 is provided at its lower extremity with a locking rib 70 adapted for snap-in reception in a locking recess 71 formed along the lower front of the base element 30.

To assemble a barrier panel 60 with a base element 30, the barrier panel is oriented with the locking ribs facing to the rear, and the mounting tabs 67, 68 are inserted vertically downward into the slots 64, 64*a* until the locking ribs 70 snap into the recesses 71. Thereafter, the barrier panel is securely locked in place, in a rigid, upright orientation.

Figure 12:
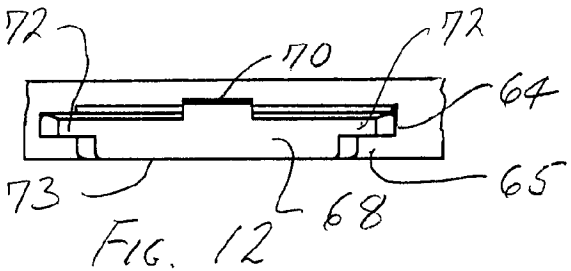
FIG. 12 is an enlarged, fragmentary view of the barrier panel of FIG. 11, as taken generally at line 12—12 of FIG. 11.

As reflected in FIG. 12, the inner mounting tabs 68 of the barrier panel 60 (and also the inner sides of the outer mounting tabs 67) are provided with laterally extending flanges 72, which are received within the vertical grooves 64, 64*a* directly behind the flanges 65. Forward portions 73 of the mounting tabs project forwardly from the flanges 72 and have a thickness substantially equal to that of the overlying flanges 65. Accordingly, in the assembled unit, the front surfaces of the housings 62 are substantially coplanar with the exposed front surfaces of the mounting tabs 67, 68 to provide a neat-appearing front structure.

Figure 3:
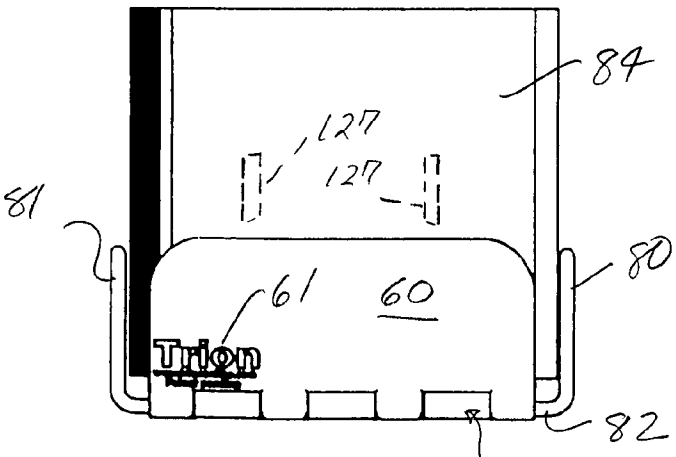
Figure 6:
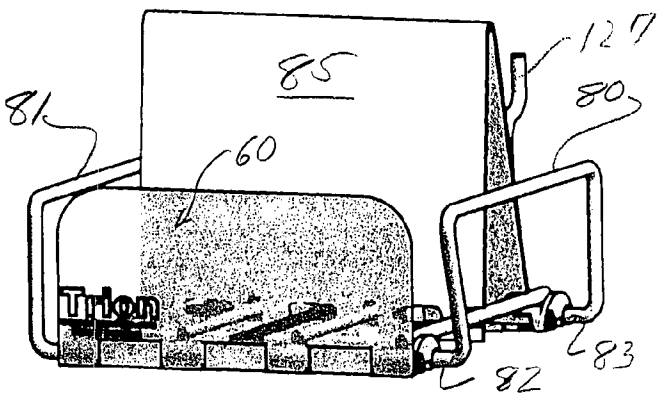
FIGS. 5 and 6 are front perspective views of the display device of FIGS. 3 and 4, shown loaded with display product in FIG. 5 and empty in FIG. 6.
Figure 5:
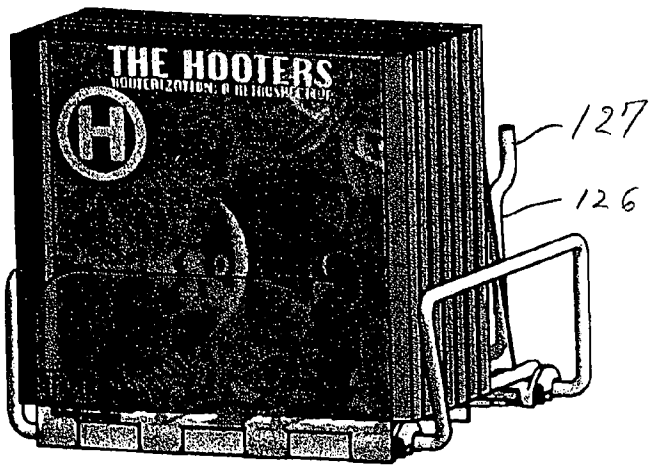

In the modified form of the invention shown in FIGS. 3–6, the display device is of stand-alone construction and is adapted for mounting on a vertically disposed apertured panel, typical of many merchandise displays. A product support 124, similar in many respects to the product support 24 previously described, is preferably comprised of four longitudinally extending wires 125 joined at front and back ends by underlying cross bars corresponding to the cross bars 29 previously described. Front and back base elements 30 are secured to the cross bar elements, and these receive an opposed pair of side guide elements 80, 81, transverse mounting portions 82, 83 of which are received in the base elements 30 as heretofore described. In FIGS. 3, 5 and 6, the side guide elements 80, 81 are illustrated in a minimum-width configuration, for the display of product items 84, for example CDs. It will be understood, however, that the side guides 80, 81 may be extended substantially outward from their illustrated positions for the accommodation of wider product items. A pusher sled 85, actuated by the spring 40, urges the product items forward against a front barrier panel 60, which is mounted as heretofore described on the front base element 30.

In the form of the invention shown in FIGS. 3–6, the base elements 30 are not intended to be supported on a shelf surface. Rather, two of the longitudinally extending wire support elements, preferably the innermost two wires in the preferred four-wire base structure, are extended to the rear and bent upwardly as shown at 126 to form L-shaped lugs 127. A spaced-apart pair of the lugs are adapted to be received in a pair of similarly spaced-apart openings in an apertured display panel in a generally well known manner, such that the product items 84 are conveniently positioned and displayed for sale.

The invention has special advantages for the type of display device shown in FIGS. 3–6, in that it enables a transparent or otherwise specified barrier panel 60 to be incorporated into the display device, rather than relying upon a section of the wire support to be bridged over the front of the display. Although a wire arch or other element can function as a limit stop to forward motion of the displayed product, the barrier panel arrangement of the invention allows for the front barrier to be designed and provided in a manner that is entirely consistent with and/or capable of enhancing the graphics and other information provided on the product packaging. In a typical case, a clear, transparent panel may be optimum. In special cases, color and/or graphics coordination, tailored to the specific product being displayed, can be provided.

The form of the invention shown in FIGS. 1–2 has additional advantages in that the wire support structure 24 can be of a flat construction. The four longitudinally extending wire elements 25–28 are straight, as are the underlying cross bars 29 at each end. This structure significantly simplifies the manufacture of the device and contributes important economies to the overall manufacturing cost.

Although the primary functional aspects of the base element 30 and front barrier panel 60 require specialized features only in the front base element, it is advantageous that the base elements be of injection molded construction, and advantageously, both the front and back base elements are of the same construction to minimize molding costs.

By reason of the injection molding of the front barrier panel, it is not only possible to maximize the clarity and transparency thereof, but it is also possible to provide for molded-in logos or other product/manufacturer identification. The injection molded components enable close tolerances to be maintained, such that a neat-appearing snug assembly of the barrier panel to the front base element is realized. The arrangement, provides for a sturdy and reliable assembly of the barrier panel to the base element, as will be appreciated.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A product display device of the type comprising (a) a wire base structure comprising a plurality of spaced-apart, straight, parallel support wires extending in a front-to-back direction, (b) front and back plastic base elements positioned beneath and secured to said base structure for supporting said base structure at front and back ends thereof, (c) pusher means slidably engaging said wire supports for applying forward pressure to product items supported on said base structure, and (a) a molded plastic barrier panel mounted on said front plastic base member, at a front portion thereof, and extending vertically upward therefrom, above said support structure, to limit forward movement of said product items on said base structure.

2. A product display device according to claim 1, wherein (a) said front base element is formed with a plurality of vertical slots therein, and (b) said barrier panel is formed with a plurality of downwardly projecting mounting tabs adapted for reception in said vertical slots.

3. A product display device according to claim 2, wherein (a) said front plastic base element is formed with a plurality of transversely spaced, forwardly projecting housings, (b) each of said housings have vertical slots therein, (c) said downwardly projecting mounting tabs being received in spaces on opposite side of said housings and having flange portions received in said vertical slots.

4. A product display device according to claim 3, wherein (a) said forwardly projecting housings are formed with generally flat, vertically oriented front faces, and (b) said mounting tabs have generally flat portions forward of said flange portions and arranged to be substantially flush with the generally flat front faces of said housings.

5. A product display device according to claim 3, wherein (a) said mounting tabs are formed with rearwardly projecting locking ribs at lower portions thereof, and (b) said front plastic base element is formed with locking recesses therein for engagement with said locking ribs when said barrier panel is assembled with said front plastic base element.

6. A product display device according to claim 1, wherein (a) said barrier panel is provided with a product-identifying logo.

7. A product display device according to claim 1, wherein (a) said wire base structure is of flat construction, comprising said plurality of support wires and front and back cross bars fixed to undersides of said support wires adjacent to front and back ends thereof.

8. A product display device according to claim 7, wherein (a) said plastic base elements are formed with an upwardly opening, transverse recess therein sized for snap-in reception of said cross bars to accommodate assembly of said base elements to said base structure, (b) said support wires extending forwardly beyond said front cross bar, and (c) said front plastic base element is formed with support surfaces for engaging at least some of said support wires on opposite sides of said front cross bar, whereby said front plastic base element is maintained in a fixed angular orientation with respect to said base structure.

9. A product display device according to claim 1, wherein (a) said base structure has front and back ends and at least the front end thereof is of flat construction, (b) front and back cross bars are fixed to undersides of said support wires adjacent to front and back ends thereof, and (c) extending portions of back ends of at least certain ones of said support wires are shaped to form hook portions for engagement with an apertured panel.

10. A product display device according to claim 1, wherein (a) said barrier panel is injection molded of a clear, transparent material.

11. A product display device according to claim 1, wherein (a) said wire base structure comprises more than two wire supports, and (b) rearward extensions of at least two of said supports being shaped to form lugs for engagement with an apertured display panel.

* * * * *